US005893022A

United States Patent [19]

Yoshino et al.

[11] Patent Number: 5,893,022

[45] Date of Patent: Apr. 6, 1999

[54] IMAGE FORMING APPARATUS

[75] Inventors: Naoto Yoshino; Masao Ohkubo; Fumio Furusawa; Yukio Hayashi; Osamu Handa, all of Ebina, Japan

[73] Assignee: Fuji Xerox Co., Ltd., Tokyo, Japan

[21] Appl. No.: 104,375

[22] Filed: Jun. 25, 1998

[30] Foreign Application Priority Data

Jun. 27, 1997 [JP] Japan ..... 9-187601

[51] Int. Cl.[6] ..... G03G 15/16

[52] U.S. Cl. ..... 399/397; 399/302; 399/308

[58] Field of Search ..... 399/302, 308, 399/316, 397, 313, 297, 400

[56] References Cited

U.S. PATENT DOCUMENTS 5,617,193 4/1997 Ban et al. ..... 399/316
5,742,887 4/1998 Suzuki et al. ..... 399/301

FOREIGN PATENT DOCUMENTS 2-213879 8/1990 Japan .

*Primary Examiner*—Arthur T. Grimley
*Assistant Examiner*—Greg Moldafsky
*Attorney, Agent, or Firm*—Oliff & Berridge, PLC

[57] ABSTRACT

There is described an image forming apparatus, wherein a visible image retained on an intermediate transfer belt is collectively transferred to recording material by means of a collective transfer device including a transfer roller and a back-up roller. The recording material that has passed through a transfer nipping region is guided by means of a recording material guide member. In such an image forming apparatus, the intermediate transfer belt is set at an angle of 50° or less relative to the reference line passing through the exit of the transfer nipping region between the transfer roller and the back-up roller among normals orthogonal to a line passing through the center shafts of the transfer roller and the back-up roller, in the area downstream from the transfer nipping region, and the recording material guide member is provided downward at an angle of 5° to 20° relative to the reference line L.

5 Claims, 9 Drawing Sheets

PRESENT INVENTION

COMPARATIVE EXAMPLE

RELATIONSHIP BETWEEN ANGLE OF INTERMEDIATE TRANSFER BELT AND RATE OF REMOVAL FAILURE / IMAGE UNEVENNESS GENERATION LEVEL

RELATIONSHIP BETWEEN ANGLE OF SHEET GUIDE PLATE AND RATE OF REMOVAL FAILURE / IMAGE UNEVENNESS GENERATION LEVEL

VARIATION IN RATE OF REMOVAL FAILURE DEPENDING ON ANGLE OF INTERMEDIATE TRANSFER BELT AND ANGLE OF SHEET GUIDE PLATE

IMAGE FORMING APPARATUS

BACKGROUND OF THE INVENTION

1. Field of the Invention

The present invention relates to an image forming apparatus, such as a copier or a laser printer, which adopts electrophotography or an electrostatic recording method, and more particularly, to an improvement in an image forming apparatus which temporarily transfers onto an intermediate transfer belt visible images formed on image carriers from electrostatic color materials (such as toner) and collectively transfer the visible images onto a recording material.

2. Description of the Background Art

In an existing and known image forming apparatus of intermediate transfer type, color toner images formed on photosensitive materials are sequentially and primarily transferred to an intermediate transfer belt, and multicolor toner images thus formed on the intermediate transfer belt are collectively transferred onto a sheet by means of a secondary transfer device (e.g., a collective transfer device) (see Unexamined Japanese Patent Application Laid-open No. Hei-2-213879).

The image forming apparatus of this type usually adopts the following system. For example, as shown in FIG. 10, the collective transfer device comprises an intermediate transfer belt 202 and a transfer roller 203 remaining in pressed contact with the outer surface of the intermediate transfer belt 202. For example, a back-up roller 204 which also serves to extend the intermediate transfer belt is provided behind the intermediate transfer belt 202 opposing the intermediate transfer roller 203. A transfer electric field is formed between the transfer roller 203 and the back-up roller 204, thus collectively transferring to a sheet the multicolor toner images formed on the intermediate transfer belt 202. In FIG. 10, reference numeral 201 designates a photosensitive material, and reference number 205 designates a power feed roller which feeds power to, e.g., the back-up roller 204.

The sheet on which the color toner images are collectively transferred is removed (peeled) from the intermediate transfer belt 202 by means of a sheet guide 206 positioned immediately behind the collective transfer device. After having been guided to a sheet transfer device (not shown), such as a transfer belt, provided in the position downstream from the collective transfer device, the sheet is transferred to a fixing device 207.

In the image forming apparatus of intermediate transfer type mentioned previously, because of restrictions on the layout of the intermediate transfer belt 202, the transfer belt 202 is configured so as to make a comparatively large angle θB relative to the direction in which is discharged the sheet that has passed through a nipping area "n" between the transfer roller 203 and the back-up roller 204 in the position downstream from the transfer nipping area "n."

In this type of layout, the intermediate transfer belt 202 forms a contact angle of about 90° relative to the back-up roller 204, which is a power feed member, in the position downstream from the transfer nipping area "n." A comparatively strong electric field is inevitably formed in the vicinity of the exit of the transfer nipping area "n."

The sheet that has passed through the transfer, nipping area "n" inevitably passes through the strong electric field. If an unfixed toner image formed on the sheet is subjected to the influence of the strong electric field, an image formed on the sheet becomes jumbled, thus resulting in picture imperfections (defects) such as retransfer of a toner image to the intermediate transfer belt from the sheet.

In terms of prevention of such image imperfections (image quality defects), it is thinkable that the intermediate transfer belt 202 will be configured so as to make a comparatively small angle relative to the direction in which is discharged the sheet that has passed through the transfer nipping area "n" in the position downstream from the transfer nipping area "n" in order to weaken the electric field produced in the vicinity of the exit of the transfer nipping area "n."

However, in this type of image forming apparatus, it is difficult to ensure a distance between the sheet, which has passed through the transfer nipping area "n," and the intermediate transfer belt 202, thus rendering technical problems apt to arise at low humidity, such as a failure to remove a sheet from the intermediate transfer belt or jumbling of an image resulting from a removal failure.

In fact, if an attempt is made to save space in so-called a tandem image forming apparatus comprising a plurality of photosensitive materials positioned on an intermediate transfer belt in order to ensure productivity, the angle between the direction in which is discharged the sheet that has passed through the transfer nipping area and the intermediate transfer belt situated in the position downstream from the transfer nipping area is set to a small angel, thus rendering technical problems, such as those mentioned previously, likely to occur.

SUMMARY OF THE INVENTION

The present invention has been conceived to solve the technical drawbacks set forth, and the object of the present invention is to provide an image forming apparatus capable of preventing an image defect (e.g., jumbling of an image and retransfer), which would otherwise be caused by an electric field in the vicinity of an exit of a transfer nipping area, and of constantly ensuring its superior ability to remove a recording material.

The present invention provides an image forming apparatus including:

at least one image carrier on which a visible image is formed from an electrification color material and the thus-formed image is retained;

an intermediate transfer belt on which the visible image is transferred from the image carrier and is temporarily retained;

a transfer roller which is pressed against the intermediate transfer belt via a recording material and which collectively transfers to the recording material the visible image retained on the intermediate transfer belt;

a back-up roller which is positioned behind the intermediate transfer belt so as to oppose the transfer roller and to remain in pressed contact with the reverse surface of the intermediate transfer belt and which forms a transfer nipping region having a predetermined width with respect to the transfer roller; and a recording material guide member which is disposed in the vicinity of an exit of the transfer nipping region between the transfer roller and the back-up roller and which guides the recording material that has passed through the transfer nipping region, wherein the intermediate transfer belt is set at an angle of 50° or less relative to the reference line L passing through the exit of the transfer nipping region between the transfer roller and the back-up roller among the normals orthogonal to a line passing through the center shafts of the transfer roller and the back-up roller, in the area downstream from the transfer nipping region, and the recording material guide member is provided downward at an angle of 5° to 20° relative to the reference line L.

BRIEF DESCRIPTION OF THE DRAWINGS

FIG. 2(*b*) is an explanatory view showing a strong electric field area developed in the vicinity of a transfer nipping region according to a comparative example.

FIG. 5(*b*) is an explanatory cross-sectional view taken along line B—B shown in FIG. 5(*a*).

DETAILED DESCRIPTION OF THE PRESENT INVENTION

Figure 1:
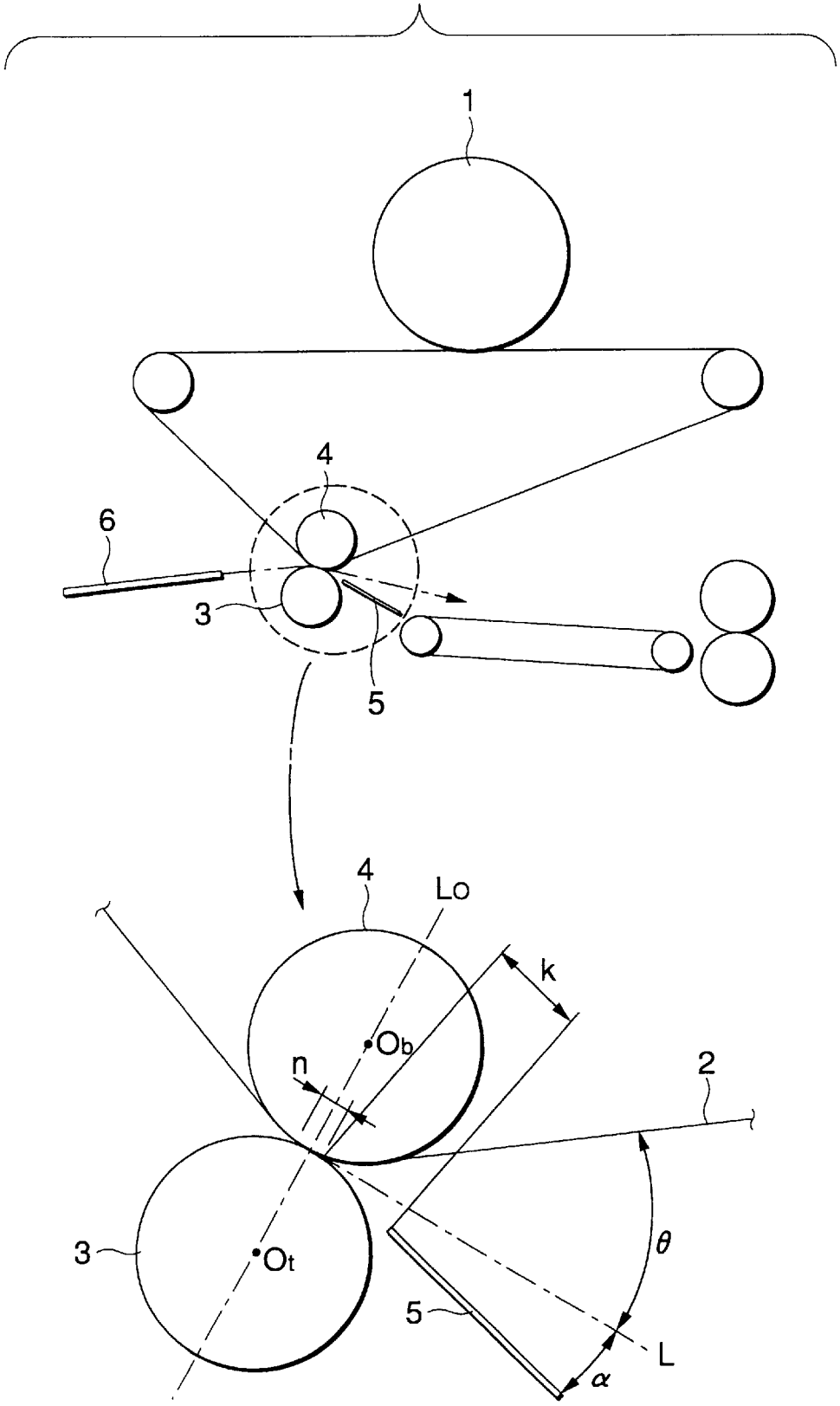
FIG. 1 is a view schematically showing the configuration of an image forming apparatus according to the present invention.

The present invention provides an image forming apparatus including:

at least one image carrier 1 on which a visible image is formed from an electrification color material and the thus-formed image is retained (as shown in FIG. 1);

an intermediate transfer belt 2 on which the visible image is transferred from the image carrier 1 and is temporarily retained;

a transfer roller 3 which is pressed against the intermediate transfer belt 2 via a recording material 6 and which collectively transfers to the recording material 6 the visible image retained on the intermediate transfer belt 2;

a back-up roller 4 which is positioned behind the intermediate transfer belt 2 so as to oppose the transfer roller 3 and to remain in pressed contact with the reverse surface of the intermediate transfer belt 2 and which forms a transfer nipping region n having a predetermined width with respect to the transfer roller 3; and a recording material guide member 5 which is disposed at the exit side of the transfer nipping region n between the transfer roller 3 and the back-up roller 4 and which guides the recording material 6 that has passed through the transfer nipping region n, wherein the intermediate transfer belt 2 is set at an angle of 50° or less relative to the reference line L passing through the exit of the transfer nipping region n between the transfer roller 3 and the back-up roller 4 among the normals orthogonal to a line $L_0$ passing through the center shafts $O_t$ and $O_b$ of the transfer roller 3 and the back-up roller 4, in the area downstream from the transfer nipping region n, and the recording material guide member 5 is provided downward at an tilt angle α of 5° to 20° relative to the reference line L.

The image forming apparatus according to the present invention may be applied to electrophotography or an electrostatic recording method, as required. Further, to form a visible image from electrification color material such as toner, one image carrier or a plurality of image carriers 1 may be used.

So long as the transfer electric field can be formed between the transfer roller 3 and the back-up roller 4, power may be applied to either the transfer roller 3 or the back-up roller 4. Further, a power feed method may be selected, as required. However, in terms of stable supply of an electric current to the transfer roller 3 or the back-up roller 4 to which power is fed, it is desirable to employ a power feed roller which uniformly comes into contact with the outer periphery of the transfer roller 3 or the back-up roller 4 in the axial direction.

The relationship in hardness between the transfer roller 3 and the back-up roller 4 may be selected, as required. However, in terms of effective prevention of a hollow character (an image imperfection (trouble) such as the blank area of center of the image), it is desirable that at least either the transfer roller 3 or the back-up roller 4 is formed so as to have low hardness and to diminish nipping load per unit area by increasing the width of the transfer nipping region n.

Particularly, in an embodiment in which the back-up roller 4 doubles as a roller for extending the intermediate transfer belt 2, a comparatively hard roller is used as a roller for extending the intermediate transfer belt 2 in order to prevent variations in rotational speed of the intermediate transfer belt 2. Further, there is a need to use a hard roller for the back-up roller 4. For these reasons, it is desirable to set such that the transfer roller 3 becomes lower in hardness than the back-up roller 4.

Figure 6:
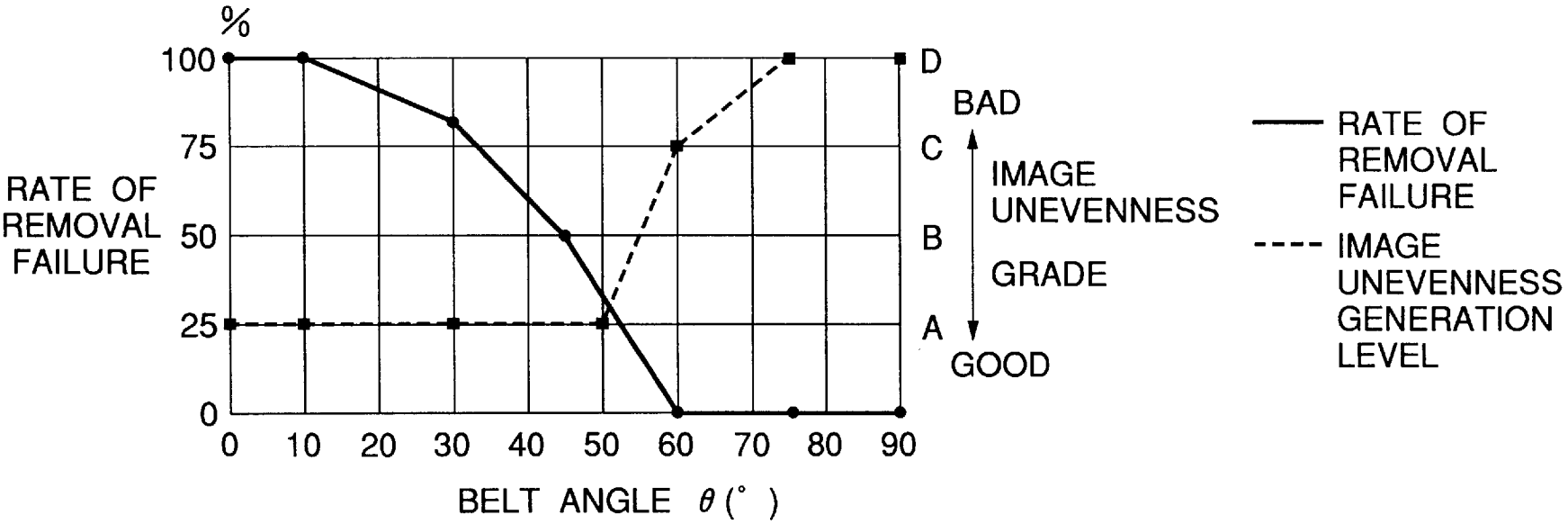
FIG. 6 is a graph showing the relationship between the angle θ of the intermediate transfer belt and the rate of removal failure and the image unevenness generation level.

For the layout of the intermediate transfer belt 2, the intermediate belt 2 is set at an angle θ of 50° or less relative to the reference line L, because there was determined through tests the range of angle in which the electric field developed in the vicinity of the exit of the transfer nipping region n is diminished and in which image imperfections, such as jumbling of an image or retransfer of toner, are prevented (see FIG. 6).

Figure 7:
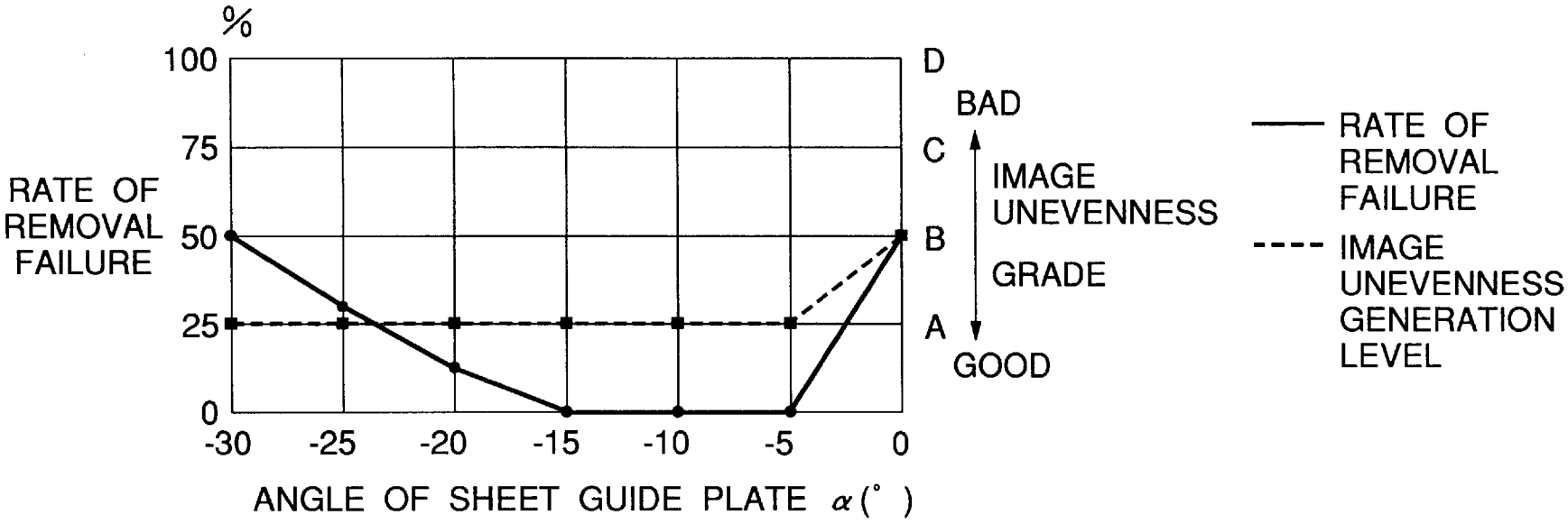
FIG. 7 is a graph showing the relationship between the angle α of the sheet guide plate and the rate or removal failure and the image unevenness generation level.

Further, for the layout of the recording material guide member 5, the recording material guide member 5 is set downward at a given tilt angle α within a range of 5° to 20°, more preferably within a range of 5° to 15°, relative to the reference line, because the removal property of the recording material 6 is ensured within the range (see FIG. 7).

To ensure the recording material guide member 5 guiding the recording material 6, it is desirable to guide the recording material 6 to the recording material guide member 5 before the recording material 6 is subjected to the influence of the electric field developed in the vicinity of (at the side of) the exit of the transfer nipping region n. It is desirable that the end of the recording material guide member 5 facing the transfer nipping region be spaced a given gap "k" (k=5 to 15 mm) apart from the exit of the transfer nipping region n.

In terms of protection of the transfer roller from damage, the end of the recording material guide member 5 facing the transfer nipping region n is desirably spaced more than 1 mm apart from the transfer roller 3.

To ensure the recording material guide member 5 guiding the recording material 6, the recording material guide member 5 should preferably be grounded, thus effectively diselectrifying the recording material guide member 5. As a result, the recording material 6 is prevented from being electrostatically attracted by the recording material guide member 5.

Further, in terms of the recording material guide member 5 ensuring the travel of the recording material 6, there is formed at least one rib on the surface of the recording material guide member 5 over which the recording material 6 travels so as to continually extend in the direction in which the recording material 6 is conveyed, thus diminishing the contact area between the recording material 6 and the recording material guide member 5.

The operation of the image forming apparatus mentioned previously will now be described.

In FIG. 1, since the influence of layout of the intermediate transfer belt 2 on picture quality is greatly determined by the electric field which the recording material 6 undergoes after having passed through the transfer nipping region n, there is a need to reduce the electric field developed in the vicinity of the exit of the transfer nipping region n.

Figure 2A:
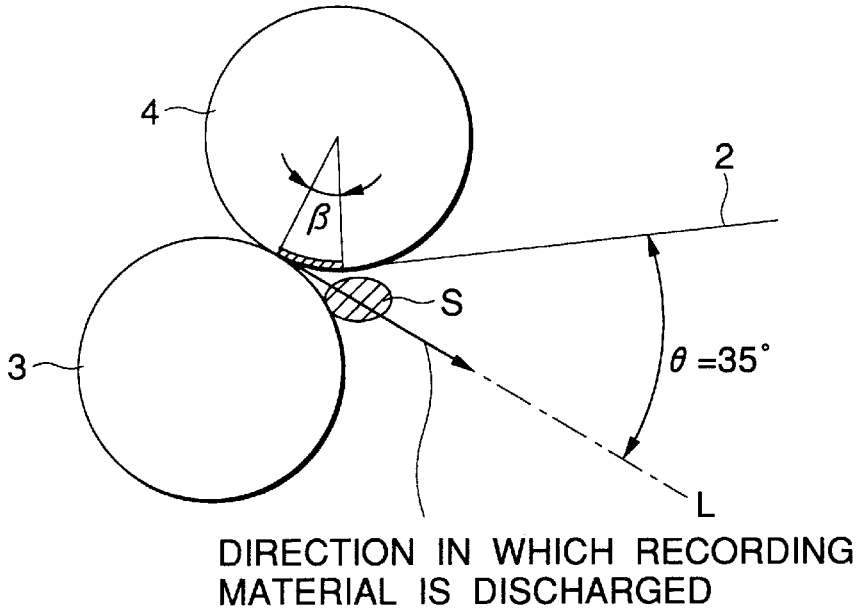
FIG. 2(*a*) is an explanatory view showing a strong electric field area developed in the vicinity of a transfer nipping region according to the present invention.
Figure 2B:
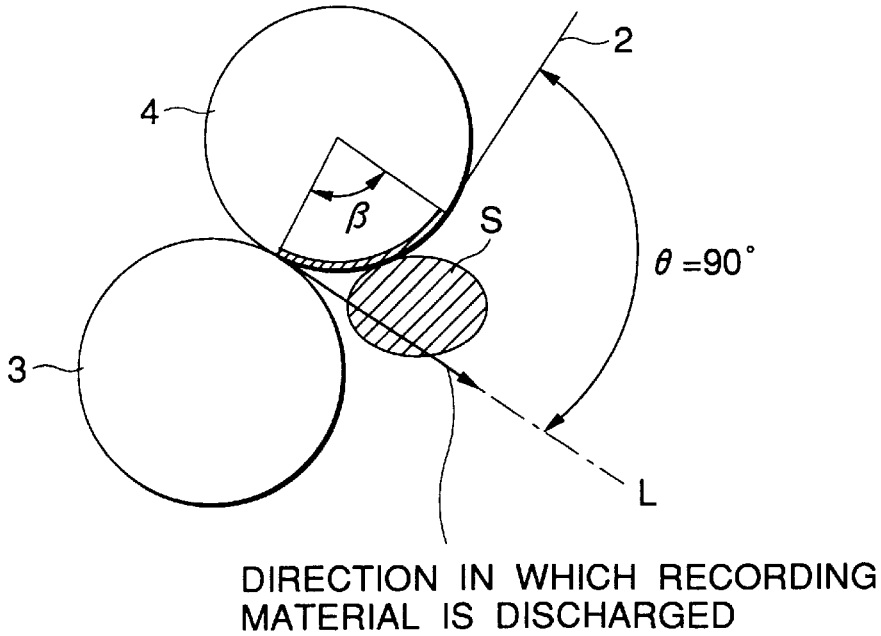

As shown in FIG. 2(*a*), in order to reduce the contact angle β at which the intermediate transfer belt 2 is wrapped around the back-up roller 4, the intermediate transfer belt 2 is set at an angle θ of 50° or less (e.g., 35°) relative to the reference line L passing through the exit of the transfer nipping region n between the transfer roller 3 and the back-up roller 4 among the normals orthogonal to a line $L_0$ passing through the center shafts of the transfer roller 3 and the back-up roller 4, in the area downstream from the transfer nipping region n.

As a result, when compared with a comparative example (shown in FIG. 2(*b*)) in which the intermediate transfer belt 2 is set at an angle θ of greater than 50°, e.g., 90°, the strong electric field developed in the area downstream from the transfer nipping region n becomes smaller. The influence of the electric field exerted on the color electrification material, such as toner, provided on the recording material 6 becomes smaller correspondingly. Therefore, image imperfections such as jumbling of an image or retransfer of toner, which would otherwise be caused by an electric field, are effectively reduced.

The failure to remove the recording material 6 is considered to be caused by combination of two factors. One factor is the direction in which the recording material 6 is discharged after having passed through the transfer nipping region n. Another factor is the force which the leading end of the recording material 6 receives in the strong electric field S. As a result of combination of these factors, there arises normal traveling of the recording material 6 or a removal failure such as the recording material 6 being attracted to the intermediate transfer belt 2.

For this reason, according to the present invention, the recording material guide member 5 is disposed at an angle of 5 to 20 degrees relative to the direction in which the recording material 6 is discharged. The direction in which the recording material 6 travels after having passed through the transfer nipping region n is determined by the recording material guide member 5 before the recording material 6 is subjected to the influence of the electric field caused by the intermediate transfer belt 2.

As a result, the recording material 6 is attracted to and travels along the recording material guide member 5 before being attracted to the intermediate transfer belt 2, thus ensuring the removal property of the recording material.

Embodiments of the present invention will be described in detail hereinbelow by reference to the accompanying drawings.

First Embodiment

Figure 3:
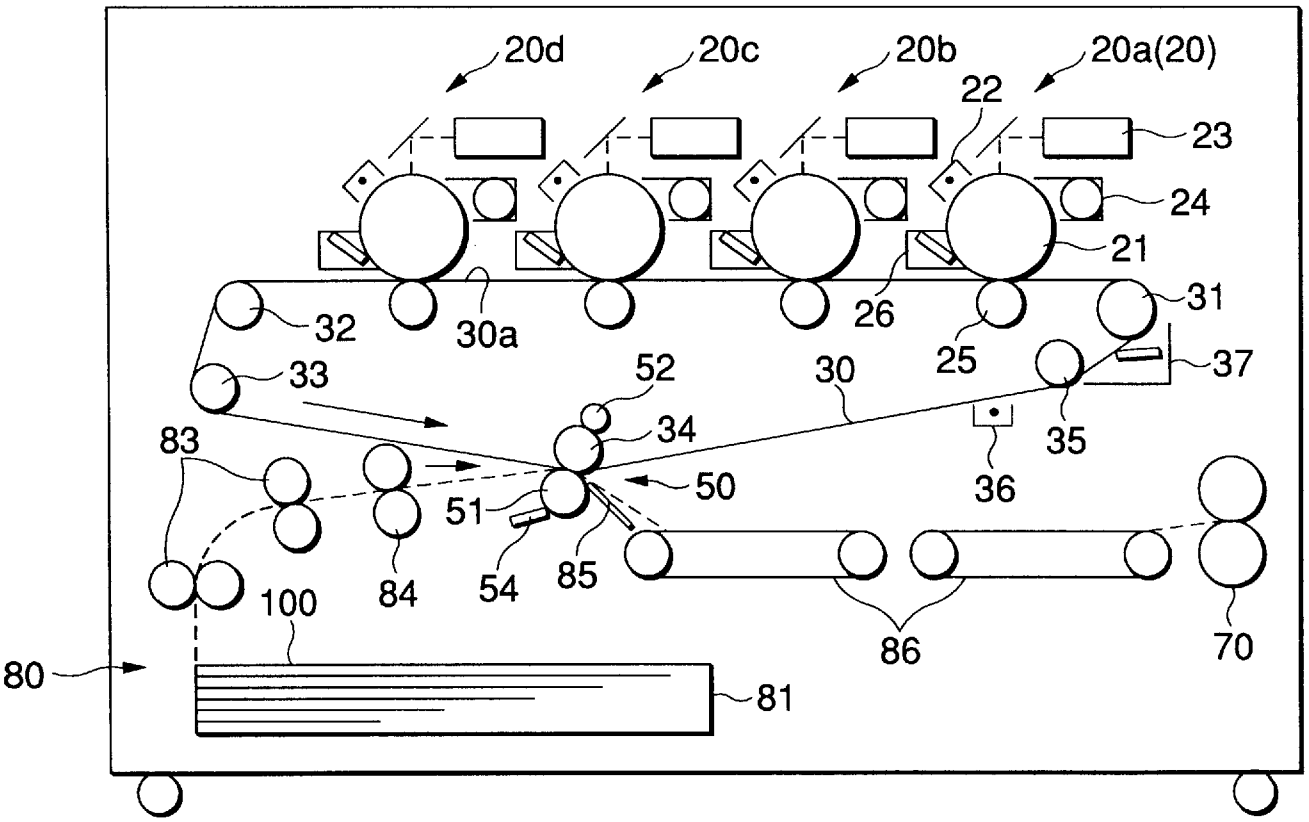
FIG. 3 is a schematic representation showing the outline of the image forming apparatus according to a first embodiment.

FIG. 3 is a view showing the entire configuration of a color image forming apparatus to which the present invention is applied.

The present invention is not limited to such an image forming apparatus. It goes without saying that the present invention can also be applied to a monochrome image forming apparatus.

The image forming apparatus shown in FIG. 3 comprises image forming units 20 (20*a* and 20*d*) which form four color component (black, yellow, magenta, cyan according to the first embodiment) images (or toner image); an intermediate transfer belt 30 on which color component images are sequentially (or primarily) transferred from the individual image forming units 20 and which retains the thus-transferred color component images; a collective transfer device 50 which collectively (or secondarily) transfers onto a sheet (or recording material) 100 the superimposed images retained on the intermediate transfer belt 30; a fixing device 70 which fixes the thus-collectively-transferred images to the sheet 100; and a sheet conveyor system 80 which supplies the sheet 100 to the collective transfer area.

In the first embodiment, each of the image forming units 20 (20*a* and 20*d*) has a photosensitive drum 21. Around each photosensitive drum 21 there are provided an electrostatic charger 22, such as corotron, which electrifies the photosensitive drum 21; an exposure device 23, such as a laser scanning device, which writes an electrostatic image (primarily including image data read by way of an unillustrated image reader or an electrostatic latent image based on image data acquired from another recording medium) on the charged photosensitive drum 21; a developing device 24 which develops the electrostatic latent image written on the surface of the photosensitive drum 21 through use of toner of each color; a primary transfer device 25, such as a transfer roller, on which a toner image formed on the photosensitive drum 21 is transferred; and a drum cleaner 26 which removes residual toner from the photosensitive drum 21.

The intermediate transfer belt 30 is formed so as to have a volume resistivity of $10^8$ to $10^{15}\Omega\cdot$cm by mixing an optimum amount of carbon black, or the like, into resin such as polyimide, polycarbonate, polyester, polypropylene, or polyethylene terephtalate or into various types of rubber. The belt is formed to a thickness of e.g., 0.1 mm.

In the first embodiment, the intermediate transfer belt 30 is extended across a plurality of support rollers 31 to 35 (five rollers in the first embodiment). A linear portion 30*a* is formed between the support roller 31, 32 so as to substantially linear extend in the direction in which the photosensitive drums 21 are arranged. The support roller 34 is spaced downward most apart from the linear portion 30*a*. To ensure an acute angle among the support rollers 32, 33, and 34, the support roller 33 is positioned outside an imaginary extension between the support rollers 32 and 34. In contrast, to ensure an obtuse angle (close to an angle of about 180 degrees in the first embodiment) among the support rollers 34, 35, and 31, the support roller 35 is positioned slightly outside an imaginary extension between the support rollers 34 and 31.

As shown in FIG. 3, according to the first embodiment, the support roller 31 is used as a drive roller driven by a belt drive motor (not shown), and the support rollers 32 and 35 are used as follower rollers. Further, the support roller 33 is used as a correction roller (i.e., a steering roller which is supported at one axial and so as to become inclined) provided in order to prevent the intermediate transfer belt 30 from traveling zigzag in the direction substantially orthogonal to the direction in which the intermediate transfer belt 30 travels. Further, as mentioned later, the support roller 34 is used as a back-up roller of the collective transfer device 50.

A diselectrification corotron 36 for diselectrifying electric charges remaining on the intermediate transfer belt 30 after a secondary transfer operation is provided so as to face the outer surface of the intermediate transfer belt 30 between the support rollers 34 and 35. Further, a belt cleaner 37 for removing the toner remaining of the intermediate transfer belt 30 after a secondary transfer operation is retractably provided between the support rollers 31 and 35 so as to oppose the surface of the intermediate transfer belt 30.

Figure 4:
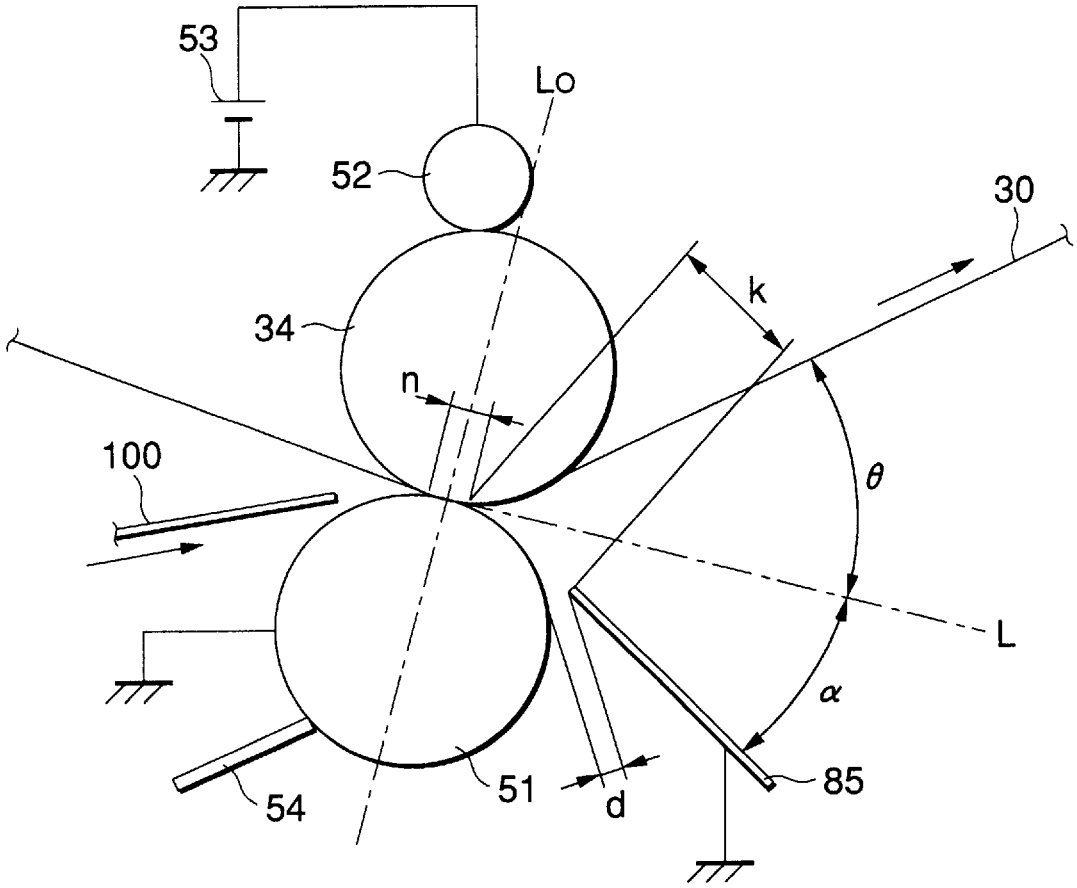
FIG. 4 is an explanatory view showing a collective transfer device employed in the first embodiment and the configuration of an area in the vicinity of the collective transfer device.

Even in the first embodiment, as shown in FIGS. 3 and 4, the collective transfer apparatus 50 has, e.g., a transfer roller 51 to be pressed against the surface of the intermediate transfer belt 30 on which the toner image is formed and an opposed roller (e.g., a back-up roller) 34 which is provided in contact with the reverse side of the intermediate transfer belt 30 and forms an electrode opposing the transfer roller 51.

The back-up roller 34 employed in the first embodiment is formed from a metal core and a two-layer EPDM which is wrapped around the outer periphery of the metal core and comprises an outer conductive layer and an inner expandable layer. The outer conductive layer is made of semi-conductive EPDM (ethylene propylene dien rubber) expandable rubber including 15 to 35 wt. % of dispersed carbon black and is formed to a thickness of 0.5 to 1.5 mm. Surface resistivity of the outer conductive layer is controlled to a resistance range from $10^7$ to $10^{10}\Omega\cdot$cm.

A metal power feed roller 52 is brought in contact with the back-up roller 34 having such a configuration. A given transfer bias voltage 53 which has the same polarity as that of toner is applied to the power feed roller 52, thus generating a transfer electric field between the back-up roller 34 and the transfer roller 51.

The transfer roller 51 comprises a metal core and a core layer which is fixed around the core metal and which comprises carbon-black-dispersed expandable urethane material. The core layer is coated with carbon-black-dispersed fluorocarbon-based material to a thickness of 5 to 20 $\mu$m via a skin layer. A volume resistivity ration of the core metal to the coating layer ranges $10^4\Omega\cdot$cm to $10^5\Omega\cdot$cm, and the transfer roller 51 has an Aska C hardness of 20° to 45°.

The transfer roller 51 is grounded, and a cleaning blade 54 made of, e.g., urethane rubber, provided around the transfer roller 51.

The sheet conveyor system 80 conveys the sheet 100 at given timing by means of a fee roller (not shown) of the paper feed tray 81. The thus-conveyed sheet 100 is transferred to a collective transfer region (i.e., a transfer nipping area) by way of a given number of conveyor rollers 83 and positioning (or registration) rollers 84.

A sheet guide plate 85 is provided in the vicinity of the exit of the transfer nipping region, and conveyor belts 86 (two belts in the first embodiment) are provided in the position downstream from the sheet guide plate 85. The sheet 100 that has passed through the fixing nipping area is guided and conveyed to the fixing device 70.

Particularly, the first embodiment is characterized by the layout of the intermediate transfer belt 30 and the sheet guide plate 85.

More specifically, as shown in FIG. 4, the intermediate transfer belt 30 is provided so as to make a given angle $\theta$ (e.g., 35°), which is smaller than 50°, relative to the reference line L passing between the transfer roller 51 and the back-up roller 34 in the transfer nipping region "n" (corresponding to an ordinary direction in which a sheet is discharged), among the normal line orthogonal to the line $L_0$ passing through the center shafts of the transfer roller 51 and the back-up roller 34, in the area downstream from the transfer nipping region "n."

The sheet guide plate 85 is provided in the position downstream from the transfer nipping region "n" so as to make a given angle $\alpha$ (e.g., 10°) within the range of 5 to 20° relative to the reference line L.

Further, in the first embodiment, the end of the sheet guide plate 85 facing the transfer nipping region "n" is spaced a given gap "k" (e.g., 7 mm) within the range of 5 to 15 mm away from the end of the exit of the transfer nipping region "n," and the sheet guide plate 85 is spaced a gap "d" of at least 1 mm or more away from the transfer roller 51.

Figure 5A:
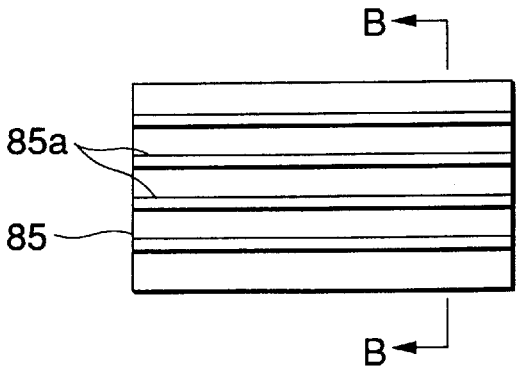
FIG. 5(*a*) is an explanatory plan view showing a sheet guide plate employed in the first embodiment.
Figure 5B:
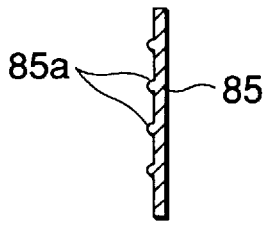

As shown in FIGS. 4 and 5, the sheet guide plate 85 is grounded, and a plurality of ribs 85*a* are formed on the surface of the sheet guide plate 85 over which the sheet 100 travels so as to continually extend in the direction in which the sheet 100 is conveyed, thus diminishing a contact area between the sheet guide plate 85 and the sheet 100.

An explanation will now be given of the basic image-forming process of the image forming apparatus according to the embodiment.

When image data for individual color components (black, yellow, magenta, cyan) are sent to the exposure device 23 of each of the image forming units 20 (20*a* to 20*d*), an electrostatic latent image for each color component is formed on the photosensitive drum 21 of the image forming unit 20, and a color unfixed toner image is formed by the developing device 24 which stores corresponding color toner.

The unfixed color toner images are superimposed on the surface of the intermediate transfer belt 30 one over another in a primary transfer region where the individual photosensitive drums 21 come into contact with the intermediate transfer belt 30 by the primary transfer device 25 applying to the base material of the intermediate transfer belt 30 a voltage which is opposite in polarity to the electrified characteristics of the toner.

In this way, the unfixed toner image primarily transferred to the intermediate transfer belt 30 is conveyed to the secondary transfer region in the path over which the sheet 100 serving as a recording medium is conveyed in association with rotation of the intermediate transfer belt 30.

In the secondary transfer region, the semi-conductive transfer roller 51 of the collective transfer device 50 is in contact with the intermediate transfer belt 30. The sheet 10 that has been conveyed at given timing by means of the registration roller 84 is inserted (or nipped) between the transfer roller 51 and the intermediate transfer belt 40. In the second transfer region, the back-up roller 34 which serves as an electrode opposing the transfer roller 51 is provided on the reverse side of the intermediate transfer belt 30. As a result of application of a transfer bias voltage having the same polarity as the electrified characteristics of the toner to the back-up roller 34 (corresponding to application of a transfer bias voltage which is opposite in polarity to the electrified characteristics of toner to the transfer roller 51), the toner image held on the intermediate transfer belt 30 is electrostatically transferred to the sheet 100 in the secondary transfer region.

The transfer roller 51 follows the rotation of the intermediate transfer belt 30, and hence the soils attached to the transfer roller 51 are removed over the entire periphery of the transfer roller by means of the cleaning blade 54, thus preventing the reverse side of the sheet 100 from being soiled.

The sheet 100 on which the toner image is transferred is exfoliated from the intermediate transfer belt 30 by means of the sheet guide plate 85 and is fed to the fixing device 70, where the toner image is fixed.

The belt cleaner 37 removes residual toner from the intermediate transfer belt 30 from which the toner image has finished being secondarily transferred.

Of such an image forming process, attention was paid to the occurrence of image unevenness when the sheet passes through the transfer nipping region of the collective transfer device 50, as well as to the behavior of the sheet. The following results were acknowledged.

In the first embodiment, there was examined the degree of image unevenness (corresponding to image imperfections such as jumbling of an image or retransfer problems) by changing angle θ at which the intermediate transfer belt 40 is provided in the position downstream from the transfer nipping region "n" relative to the direction L in which the sheet is discharged. As indicated by the dot line shown in FIG. 6, when angle θ is 50° or less, the image unevenness is graded A (superior; a degree at which image unevenness is not visually noticeable). In contrast, when angle θ exceeds 50°, the degree of image unevenness becomes gradually and visually deteriorated.

Accordingly, it can be understood that, so long as the angle θ at which the intermediate transfer belt 30 is provided is set to 50° or less, image unevenness will be effectively prevented.

Further, there was examined a rate at which failures to remove the sheet 100 arise at low humidity without use of the sheet guide plate 85 by changing the angle θ at which the intermediate transfer belt 30 is provided. As can be seen from the solid line shown in FIG. 6, the smaller the angle θ at which the intermediate transfer belt 30 is provided, the greater the rate at which a sheet is removed.

There was also examined the rate at which failures to remove a sheet arise by changing the angle α at which the sheet guide plate 85 is provided in the direction L of discharge of a sheet, while was set to 35° the angle θ at which the intermediate transfer belt 30 is provided in the position downstream from the transfer nipping region "n" relative to the direction L of discharge of a sheet. As indicated by a solid line provided in FIG. 7, so long as the sheet guide plate 85 is provided at an angle of 5° to 20° (a minus symbol denotes a direction below the reference direction L) in a downward direction relative to the direction L of discharge of a sheet, substantially no failures to remove a sheet arise. Particularly, it has been admitted that when the sheet guide plate 85 is provided at an angle of 5° to 15°, no failures to remove a sheet are observed.

Similarly, the degree of image unevenness (image unevenness resulting from sheet removal failures) are examined while the angle α at which the sheet guide plate 85 is positioned was changed relative to the direction L of discharge of a sheet. As indicated by a dot line shown in FIG. 7, it is acknowledged that, so long as the sheet guide plate 85 is provided downward at an angle of 5° or more relative to the direction L in which the sheet is discharged, no image unevenness arises at all.

Figure 8:
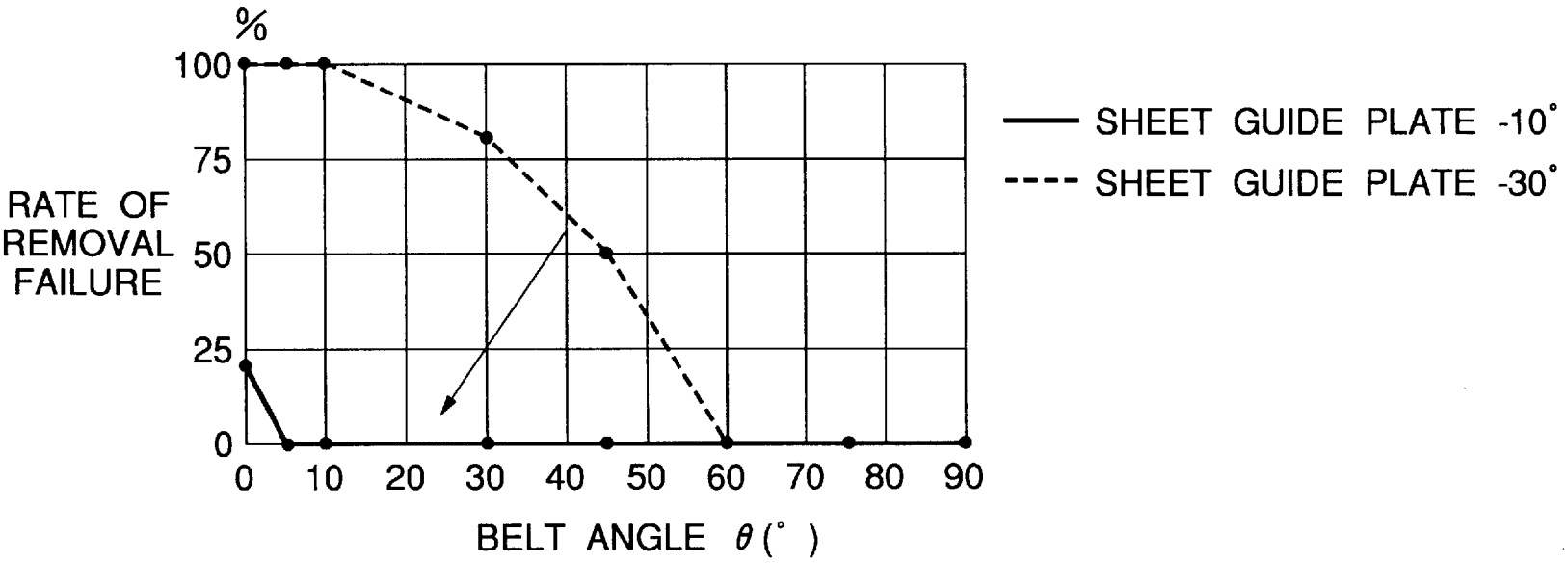
FIG. 8 is a graph showing variations in the rate of removal failure depending on the angle θ of the intermediate transfer belt and at the angle θ of the sheet guide plate.

Further, the rate of sheet removal failures was examined by changing the angle θ at which is provided the intermediate transfer belt 30 in the position downstream from the transfer nipping region "n" relative to the direction L in which a sheet is discharged, and by changing the angle α at which the sheet guide plate 85 is provided within a range of 10° to 30° relative to the direction L in which a sheet is discharged. As shown in FIG. 8, in an example in which the sheet guide plate 85 is provided at an angle α of 30°, it is acknowledged that when the intermediate transfer belt 30 is provided at an angle θ of 50° or less, the rate of sheet removal failures becomes gradually deteriorated. In contrast, in the example in which the sheet guide plate 85 is provided at an angle α of 10°, even when the angle θ at which the intermediate transfer belt 30 is provided is 50° or less, substantially no sheet removal failures are observed. Particularly, it is acknowledged that no sheet removal failures are observed, if the angle θ at which the intermediate transfer belt 30 is provided is set to a range of 5° to 50°.

Accordingly, so long as the sheet guide plate 85 is provided at an angle α of 5° to 20° relative to the direction L in which a sheet is discharged, more preferably the sheet guide plate is provided downward at an angle of 5° to 15°, the removal property of a sheet is appropriately maintained even when the intermediate transfer belt 30 is provided at an angle θ of 50° or less.

Further, according to the first embodiment, since the sheet guide plate 85 is grounded, unnecessary electric charges are prevented from being stored in the sheet guide plate 85. In addition, the plurality of ribs 85*a* are formed on the surface of the sheet guide plate 85 over which a sheet is conveyed, the sheet 100 is prevented from coming contact with the overall surface of the sheet guide plate 85, thus preventing the sheet guide plate 85 from electrostatically attracting the sheet 100. For this reason, the sheet is stably and smoothly conveyed.

Second Embodiment

Figure 9:
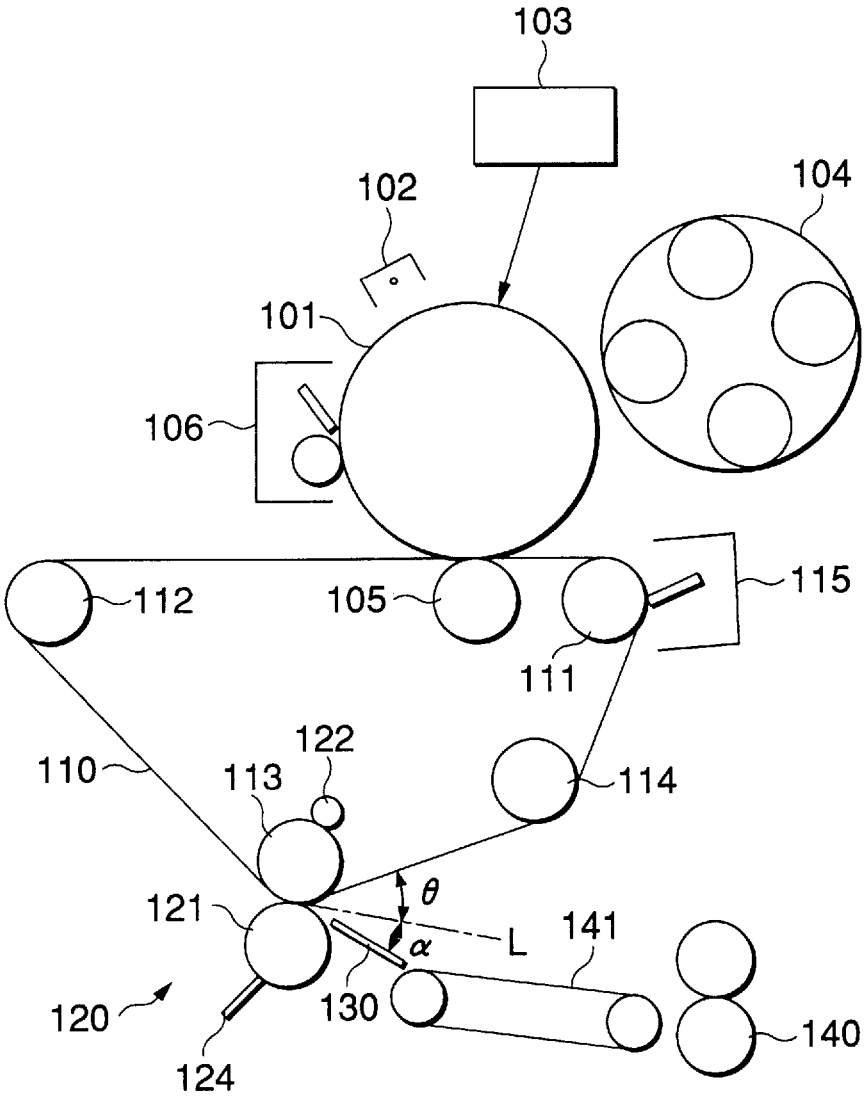
FIG. 9 is an explanatory view showing the outline of an image forming apparatus according to a second embodiment.
Figure 10:
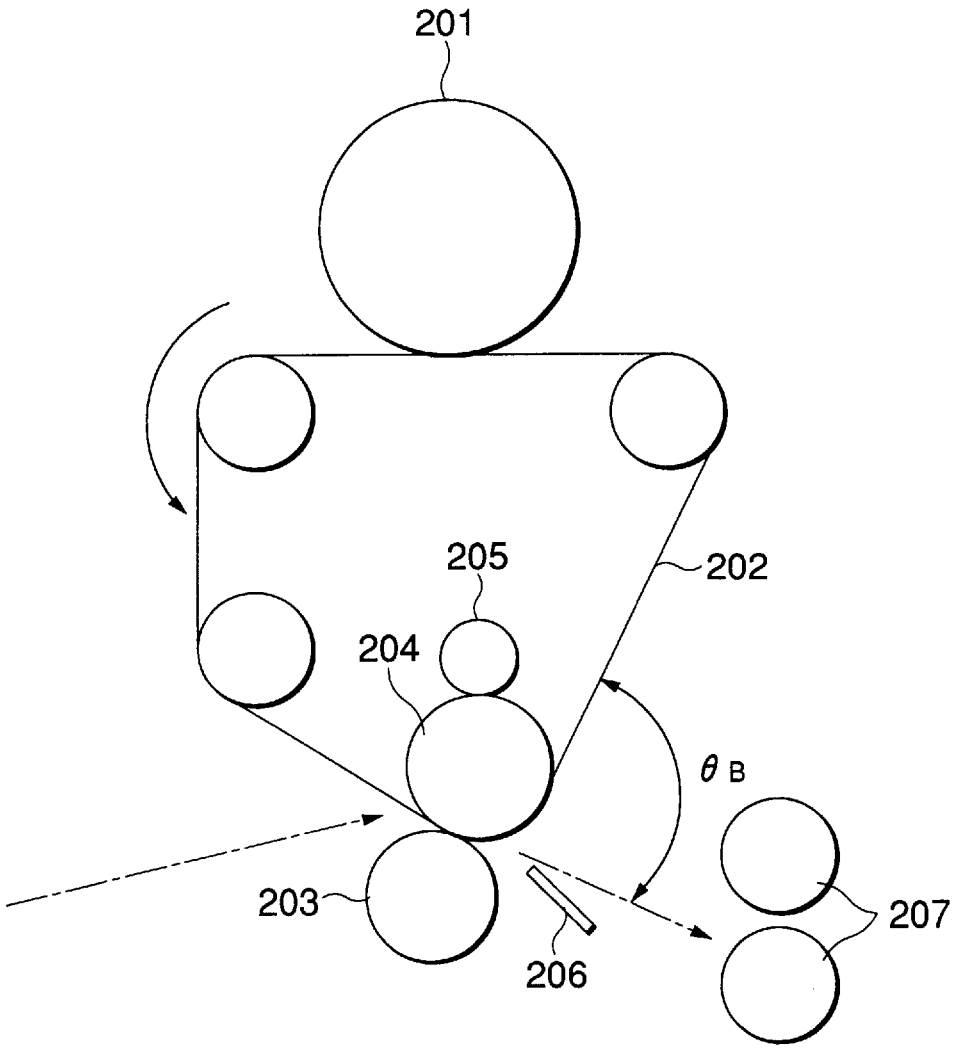
FIG. 10 is an explanatory view showing one example of an existing image forming apparatus.

FIG. 9 shows an image forming apparatus according to a second embodiment of the present invention.

FIG. 9, in contrast with the image forming apparatus according to the first embodiment, the image forming apparatus has one photosensitive drum 101 and an intermediate transfer belt 110 provided so as to remain in contact with the photosensitive drum 101. Around the photosensitive drum 101, there are provided an electrification device 102 for electrifying the photosensitive drum 101; an exposure device 103 which writes an electrostatic latent image for each color; a rotary developing device 104 which is equipped with a plurality of developers, each developer having color toner stored therein, and which visualizes the electrostatic latent image through use of corresponding toner while being intermittently positioned so as to oppose the photosensitive drum 101; a primary transfer device 105, such as a transfer roller, which transfers each color toner image formed on the photosensitive drum 101 to the intermediate transfer belt 110; and a drum cleaner 106 which removes residual toner from the photosensitive drum 101.

The transfer belt 110 is extended across, e.g., four rollers 111 to 114. A collective transfer device 120 which is substantially identical in structure with the collective transfer device according to the first embodiment is provided so as to oppose the roller 113.

Reference numeral 115 designates a belt cleaner for removing residual toner from the intermediate transfer belt 110.

The collective transfer device 120 comprises a transfer roller 121 which is provided so as to be pressed against the surface of the intermediate transfer belt 110 on which the toner image is held; and an opposed roller (i.e., a back-up roller) 113 which is provided behind the intermediate transfer belt 110 and which serves as an electrode opposing the transfer roller 121. A transfer bias voltage (not shown) is applied to the transfer roller 121 and the back-up roller 113 by way of a power feed roller 122, thus producing a transfer electric field for the purpose of collectively transferring images. A cleaning blade 124 is provided on the transfer roller 121.

Further, according to the second embodiment, the intermediate transfer belt 110 is provided so as to make a predetermined angle θ, which is less than 50°, relative to the direction L of discharge of a sheet passing through the transfer nipping region, in the area downstream from the transfer nipping region of the collective transfer device 120, as in the case of the first embodiment. Further, in the vicinity of an exit of the transfer nipping region, there is provided a sheet guide plate 130 which becomes inclined downward at a given angle α within a range of 5° to 20° relative to the direction L of discharge of a sheet.

In FIG. 9, reference numeral 140 designates a fixing device, and reference numeral 141 designates a conveyor belt which conveys to the fixing device 140 the sheet that has passed through the transfer nipping region.

Consequently, according to the second embodiment, there is employed an image forming process in which a color toner image is formed on the photosensitive drum 101 and is sequentially and primarily transferred to the intermediate transfer belt 110, and in which the multicolor toner images formed on the intermediate transfer belt 110 are collectively transferred to the sheet 100.

At this time, the toner image formed on the photosensitive drum 101 is transferred to an identical position on the intermediate transfer belt 110 in a superimposing manner, and the thus-superimposed image is secondarily transferred. Therefore, there is a need to hold the transfer roller 121 of the collective transfer device 120 in a position spaced apart from the intermediate transfer belt 110 until the unfixed toner image of the last color is primarily transferred to the intermediate transfer belt 110.

In the second embodiment, the occurrence of image unevenness and the rate of sheet removal failures were examined. It is acknowledged that neither image unevenness nor sheet removal failures substantially occur at the time of collective transfer of images (i.e., at the time of passage of a sheet through the transfer nipping region).

As has been described above, according to the present invention, the electric field developed in the vicinity of the exit of the transfer nipping region is diminished by changing the positional relationship between the intermediate transfer belt and a recording material guide member. Further, before being subjected to the influence of the electric field, a recording material is guided by means of the recording material guide member, thus thoroughly preventing image imperfections such as jumbling of an image or retransfer of toner, which would otherwise be caused by the electric field. Further, the superior removal property of the recording material can be ensured.

What is claimed is:

1. An image forming apparatus comprising:

at least one image carrier on which a visible image is formed from an electrification color material and the thus-formed image is retained;

an intermediate transfer belt on which the visible image is transferred from the image carrier and is temporarily retained;

a transfer roller which is pressed against the intermediate transfer belt via a recording material and which collectively transfers to the recording material the visible image retained on the intermediate transfer belt;

a back-up roller which is positioned behind the intermediate transfer belt so as to oppose the transfer roller and to remain in pressed contact with the reverse surface of the intermediate transfer belt and which forms a transfer nipping region having a predetermined width with respect to the transfer roller; and a recording material guide member which is disposed in the vicinity of an exit of the transfer nipping region between the transfer roller and the back-up roller and which guides the recording material that has passed through the transfer nipping region, wherein the intermediate transfer belt is set at an angle of 50° or less relative to a reference line passing through the exit of the transfer nipping region between the transfer roller and the back-up roller among the normals orthogonal to a line passing through the center shafts of the transfer roller and the back-up roller, in the area downstream from the transfer nipping region, and the recording material guide member is provided downward at an angle of 5° to 20° relative to the reference line.

2. The image forming apparatus as claimed in claim 1, wherein the end of the recording material guide member facing the transfer nipping region is spaced 5 to 15 mm apart from the exit of the transfer nipping region.

3. The image forming apparatus as claimed in claim 1, wherein the end of the recording material guide member facing the transfer nipping region is spaced at least 1 mm apart from the transfer roller.

4. The image forming apparatus as claimed in claim 1, wherein the recording material guide member is grounded.

5. The image forming apparatus as claimed in claim 1, wherein on the surface of the recording material guide member over which the recording material travels, there are formed ribs so as to continually extend in the direction in which the recording material is conveyed.

* * * * *